United States Patent [19]

Cline

[11] 4,420,002

[45] Dec. 13, 1983

[54] WRAPPER FOR SMOKING ARTICLES AND METHOD

[75] Inventor: Warren K. Cline, Brevard, N.C.

[73] Assignee: Olin Corp., Pisgah Forest, N.C.

[21] Appl. No.: 366,313

[22] Filed: Apr. 7, 1982

[51] Int. Cl.[3] ..... A24D 1/02; A24D 3/16

[52] U.S. Cl. ..... 131/334; 131/335; 131/365

[58] Field of Search ..... 131/365, 334, 335

[56] References Cited

U.S. PATENT DOCUMENTS 4,231,377 11/1980 Cline et al. ..... 131/365

*Primary Examiner*—J. Millin

*Attorney, Agent, or Firm*—Kerkam, Stowell, Kondracki & Clarke

[57] ABSTRACT

There is disclosed a wrapper for smoking articles such as cigarettes, cigars and the like comprising a cellulosic sheet containing a filler of fine grain magnesium hydroxide having an average particle size less than 10 micrometers and unreactive magnesium oxide.

This is also disclosed a method for reducing the visible sidestream smoke emanating from a smoking article and solidifying the ash by wrapping the tobacco charge in the smoking article in a combustible cellulosic sheet containing a filler of fine grain magnesium hydroxide having an average particle size less than 10 micrometers and unreactive magnesium oxide.

20 Claims, 1 Drawing Figure

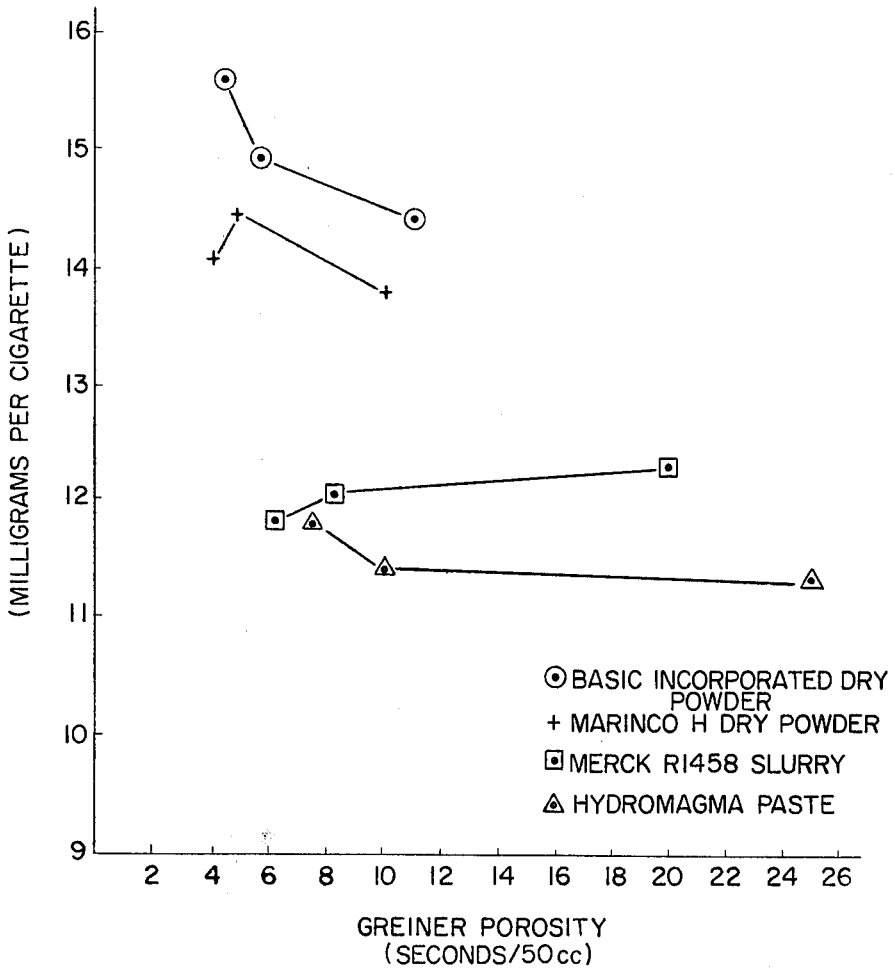
16
15
14
13
12
11
10
9
(MILLIGRAMS PER CIGARETTE)
2
4
6
8
10
12
14
16
18
20
22
24
26
GREINER POROSITY
(SECONDS/50cc)
BASIC INCORPORATED DRY POWDER
+ MARINCO H DRY POWDER
MERCK R1458 SLURRY
HYDROMAGMA PASTE

WRAPPER FOR SMOKING ARTICLES AND METHOD

TECHNICAL FIELD

This invention relates generally to smoking articles such as cigarettes, cigars and the like and the wrapper for the tobacco column thereof, and more particularly to an improved wrapper for such smoking articles for use either by itself or as an inner wrapper in combination with a conventional outer wrapper.

BACKGROUND OF THE PRIOR ART

A problem associated with smoking articles such as cigarettes or cigars is the amount of sidestream smoke that is given off during static burning, for example when the smoking article is idling and not being drawn upon by the smoker or is simply resting in an ashtray while burning. Visible sidestream smoke that is given off by a smoking article such as a cigarette during static burning is irritating and objectionable to nonsmokers in the vicinity of the idling cigarette.

A problem with heretofor developed wrappers that produced low sidestream smoke is that they give a flaky and/or off color ash due to poor ashing characteristics of the wrappers. Various mechanisms have been incorporated into smoking articles to reduce visible sidestream smoke and to improve the ashing characteristics of wrappers, but none to date has been commercially successful in overcoming both of these problems.

Probably the most effective means of reducing visible sidestream smoke, to date is disclosed and claimed in U.S. Pat. No. 3,231,377, Cline et al owned by applicant's assignee. Olin Corporation.

In this patent there is disclosed a wrapper for smoking articles such as cigarettes, cigars and the like containing at least 15% by weight magnesium oxide or its hydrate and at least 0.5% by weight of specific chemical adjuvant such as the alkali metal acetates, carbonates, citrates, nitrates or tartrates. The combination of magnesium oxide or its hydrate with any of the chemical adjuvants significantly reduces visible sidestream smoke that emanates during static burning from smoking articles employing the wrapper. The wrapper may comprise conventional cigarette paper with magnesium oxide and the adjuvant incorporated therein as the filler in the paper furnish or either or both of the additives may be applied to the paper as a coating. Wrappers containing the additives can be used in place of conventional wrappers for smoking articles or used as an inner wrapper for the tobacco column in combination with a conventional outer wrapping of cigarette paper or cigar wrap.

Following the teaching of this patent substantial and very desirable reduction in visible sidestream smoke can be achieved by using cigarette paper containing magnesium oxide as a filler in combination with certain chemical adjuvants. These papers have consistently given a flaky ash and have been determined to be unacceptable for use by the cigarette manufacturers due to the poor ashing characteristics. Extensive testing has not identified any chemical adjuvant or burning chemical or combination thereof which overcomes this problem.

The more reactive grades of magnesium oxide which are very effective as sidestream reducing fillers are at least partially converted to magnesium hydroxide during the papermaking process. MagChem 40, manufactured by the Martin Marietta Company, is an example of this type of product which gives a very flaky cigarette paper ash. In contrast, a hard-burned, unreactive magnesium oxide such as MagChem 10, produced by the same company, gives a white, solid ash which shrinks and holds on well. This unreactive oxide hydrates to give magnesium hydroxide only very slowly at ambient temperatures and remains essentially unchanged in the finished paper when used as a filler. Papers filled with unreactive magnesium oxide give no sidestream smoke reduction beyond that which can be achieved with calcium carbonate at equivalent high levels of basis weight, and burn rate accelerators.

These facts lead to the conclusion that magnesium hydroxide is a necessary ingredient if optimum sidestream reduction is to be achieved. It was speculated that if the effect of magnesium hydroxide on cigarette combustion was due to its endothermic dehydration at approximately 350° C., then the yield of sidestream tar should be inversely related to the amount of magnesium hydroxide in the paper. This has been determined not to be entirely true. Thus, MagChem 40, completely hydrated by slurrying in water overnight, is no more effective than when used without pretreatment to make handsheets. Approximately 50% of the unpretreated filler was converted to magnesium hydroxide during the process of making the handsheets. Also, powdered magnesium hydroxide used as the only filler component gave no greater sidestream reduction than the partially hydrated oxide and gave a darker, very flaky ash.

BRIEF SUMMARY OF THE INVENTION

It is an object of this invention to provide an improved cellulosic wrapper for smoking articles which has reduced sidestream smoke and a solid non-flaking ash.

A further object is to provide an improved cellulosic wrapper and smoking articles wrapped therein which avoids the expense and possible hazards of adding inorganic fibers to the wrapper to provide non-flaking ash.

These objects and advantages are provided by my discovery that probably intimate contact between magnesium hydroxide and cellulose fibers is required for effective sidestream smoke reduction. Thus then as the amount of filler added to the paper increases a point is reached where additional quantities of magnesium hydroxide no longer contact fiber surfaces but deposit on filler already laid down, forming larger aggregates. Further then magnesium hydroxide with a small particle size should be effective in covering the fiber surfaces at a lower overall content in the sheet.

In general the average particle size should be not greater than 10 micrometers and preferably not greater than 2 micrometers.

Since poor ash has been found to be related to magnesium hydroxide concentration in the sheet, it should be possible to achieve both improved ash and a low sidestream smoke yield by using an inert filler such as MagChem 10 (a non-reactive magnesium oxide) with a minor proportion of fine particle size magnesium hydroxide. Experiments have shown that this can be done.

The invention then consists of an improved cigarette paper product which gives greatly reduced yields of sidestream tar and visible sidestream smoke while giving a light colored solid ash which tends to hold on rather than to flake off the smoking article. The filler in the paper consists of a mixture of a major amount of unreactive magnesium oxide or other inert fillers with a minor amount of finely divided magnesium hydroxide. The paper should also contain a burn rate accelerating chemical adjuvant as described in U.S. Pat. No. 4,231,377.

BRIEF DESCRIPTION OF THE DRAWING

The drawing is a chart illustrating sidestream tar yields plotted against porosity for the tests set forth in Example III.

DETAILED DESCRIPTION OF THE INVENTION

Cellulosic wrappers made according to this invention may be made by incorporating the magnesium hydroxide and unreactive magnesium oxide fillers in the wrapper pulp furnish. Additionally, other inert fillers may be used in combination with $Mg(OH)_2$ and MgO such as calcium carbonate. The $Mg(OH)_2$ and MgO fillers may be applied to the improved wrapper as a coating, but this is not as desirable because it does not provide as much contact between the fillers and the fiber of the paper. In the case of cigarette papers, the fillers and magnesium hydroxide are added to an ordinary paper furnish such as pulped wood or flax fibers. The furnish of fiber pulp, magnesium hydroxide and fillers are then used to make a paper sheet on conventional papermaking machines.

The magnesium hydroxide and fillers may be added to fiber pulps customarily used to make cellulsoic paper wrappers for cigarettes or the tobacco materials used to make cigar wrap. Thus, in addition to wood and flax fibers, the furnish may be pulped tobacco stalks or stems to which is added a small percentage of fine particle magnesium hydroxide and unreactive magnesium oxide.

Smoking article wrappers containing the small percentage of magnesium hydroxide and the unreactive magnesium oxide with or without the other fillers according to this invention may be used as an inner wrapper under a normal outer wrapper for the tobacco column of the cigarette or cigar. Conventional cigarette paper, and preferably very porous or perforated cigarette paper, or cigar wrap may be used as the outer wrapping for the smoking article. Such a combination can reduce the tobacco weight necessary to make a satisfactory product, increases the tobacco rod firmness, and does not alter the appearance of the cigarette or cigar. Wrappers containing the additives according to this invention also may be used as the single wrap for smoking articles. With cigarettes, it is especially desirable to use high basis weight papers if only a single wrap is employed.

As heretofor set forth, some reduction in sidestream smoke and improvement in the ash appearance results when these fillers are used at the typical cigarette paper levels of 30% and basis weights in the range of 25 g/M$^2$. Optimum benefits will be achieved at basis weights of 40 g/M$^2$ to 100 g/M$^2$ and total filler levels of 40% to 60%. The concentration of magnesium hydroxide in the filler will depend on its particle size among other things but will range between 5% to 50% or 2.5% to 25% of total sheet weight for paper with 50% total filler. For best results the wrappers should also contain at least 0.5% and preferably 2% or more of at least one of the class of burn rate accelerating chemical adjuvants disclosed in U.S. Pat. No. 3,231,377.

All of the handsheets in the following examples, which illustrate the invention, were made to contain 50% total filler as 100 g/M$^2$ basis weight. All were treated on the size press with 3.0% sodium acetate. Test cigarettes were rerolled using matched weights of Kentucky Referee 1R3 tobacco. Except where noted flax from the same beater run was used for all handsheets within each example.

EXAMPLE I

HydroMagma, magnesium hydroxide paste manufactured by Merck and Company, has an everage particle size much below 1 micrometer. This example compares mixtures of HydroMagma and MagChem 10 (an unreactive magnesium oxide) to similar mixtures of MagChem 10 and a sample of dry powdered magnesium hydroxide (supplied by Basic, Incorporated) with a particle size in the 10 micrometer range. The results are tabulated below:

| Filler Composition | Greiner Porosity (seconds/50cc) | Sidestream Tar (mg/cigarette) | Average Burning Time (minutes) |
|---|---|---|---|
| 75% MagChem 10/ 25% HydroMagma | 61.0 | 9.6 | 13.8 |
| 50% MagChem 10/ 50% HydroMagma | 112.0 | 9.8 | 14.6 |
| 75% MagChem 10/ 25% Magnesium Hydroxide Powder | 22.9 | 13.0 | 10.4 |
| 50% MagChem 10/ 50% Magnesium Hydroxide Powder | 19.2 | 12.3 | 9.9 |
| 100% MagChem 40* (Control) | 16.3 | 10.3 | 9.4 |

*(MagChem 40 manufactured by Martin Marietta Company, is a reactive form of magnesium oxide which is partially converted to magnesium hydroxide during the papermaking process)

The comparison of the two forms of magnesium hydroxide is slightly flawed by the fact that different flax stock was used in the two cases. It is evident, however, that the magnesium hydroxide with the smaller particle size is more effective in reducing sidestream tar. The ash from all papers with the mixed fillers was much more solid and lighter in color than that from the control.

EXAMPLE II

In this series of test handsheets MagChem 10 was again used as the unreactive portion of the filler along with various levels of magnesium hydroxide derived from a slurry supplied by Merck and Company and designated as R1458. The average particle size of this magnesium hydroxide was larger than that of the HydroMagma of the previous example but still less than 1 micrometer. The results are tabulated below:

| Percent Magnesium Hydroxide In Filler | Greiner Porosity (seconds/50cc) | Sidestream Tar (mg/cigarette) | Average Burning Time (minutes) |
|---|---|---|---|
| 25 | 25.0 | 11.3 | 10.4 |
| 20 | 22.8 | 11.5 | 9.7 |
| 15 | 22.0 | 11.6 | 9.8 |
| 10 | 20.6 | 12.0 | 9.6 |
| 5 | 20.9 | 14.5 | 9.5 |
| MagChem 40 Control | 10.5 | 9.6 | 9.9 |

As in Example I all of the papers with mixed filler gave lighter colored, less flaky ash than the MagChem 40 control.

EXAMPLE III

In this example, 75:25 mixtures of MagChem 10 with four different types of magnesium hydroxide were each used to make handsheets from three different flax stocks refined to different levels of weight length and freeness. The magnesium hydroxides used in this study were the HydroMagma paste; R1458 slurry; the Basic, Incorporated dry powder; and another dry powder of similar particle size manufactured by Merck and Company called Marinco H. The results are presented graphically in the drawing where sidestream tar yields are plotted against porosity which is related to the degree of refining. While there may be some minor differences due to other factors, clearly particle size of the magnesium hydroxide is the most important variable affecting sidestream yield. Thus, the curves for the HydroMagma paste and R1458 slurry with their much smaller particle size lie close together and much below those for the two dry powders which have larger particles.

EXAMPLE IV

Two aqueous dispersions of magnesium hydroxide supplied by Dow Chemical Company were used in this example. One of these, a commercial product called MHT-60, has a mean particle size in the 5 to 10 micrometers range. The other micronized (wet ground) version of MHT-60 had an average particle size less than 1.0 micrometer. The other component of the filler was either MagChem 10 magnesium oxide or Mississippi Lime Company bagged calcium carbonate. The results of tests on cigarettes rerolled in these papers are tabulated below:

| Filler Composition | Greiner Porosity (seconds/ 50cc) | Sidestream Tar (mg/ cigarette) | Average Burning Time (minutes) |
|---|---|---|---|
| 75% MagChem 10/ 25% MHT-60 (Micronized) | 17.0 | 11.5 | 9.3 |
| 75% MagChem 10/ 25% MHT-60 | 10.0 | 13.6 | 10.3 |
| 75% Calcium Carbonate 25% MHT-60 (Micronized) | 17.5 | 13.0 | 9.9 |
| 75% Calcium Carbonate 25% MHT-60 | 12.5 | 13.3 | 10.0 |
| 100% MagChem 10 Control | 9.3 | 18.7 | 10.3 |

When used in combination with MagChem 10 the micronized MHT-60 with its smaller particle size was more effective in reducing sidestream tar yield. This effect was not apparent in the mixtures with calcium carbonate. These fillers did give substantially more sidestream reduction than the MagChem 10 control. All of the handsheets of this example gave lighter colored ash than paper made with magnesium hydroxide or one of the reactive grades of magnesium oxide as the only filler.

STATEMENT OF INDUSTRIAL APPLICATION

Cellulosic wrappers for smoking articles are made with fillers of fine grain magnesium hydroxide and unreactive magnesium oxide. Additionally, other inert fillers such as calcium carbonate may be used in a wrapper pulp furnish. The magnesium hydroxide and unreactive magnesium oxide may be applied to the improved wrapper as a coating although this is less effective. In the case of cigarette papers, the materials are added to an ordinary paper furnish such as pulped wood or flax fibers. The furnish of fiber pulp, magnesium hydroxide and magnesium oxide fillers are then used to make a paper sheet on conventional papermaking machines.

I claim:

1. A wrapper for smoking articles such as cigarettes, cigars and the like comprising a cellulosic sheet containing a filler of fine grain magnesium hydroxide having an average particle size less than 10 micrometers and unreactive magnesium oxide.

2. The wrapper as defined in claim 1 wherein the magnesium hydroxide is present in a range between 5% to 50% of the total weight of the cellulosic sheet.

3. The wrapper as defined in claims 1 or 2 wherein the particle size of magnesium hydroxide is not greater than 10 micrometers.

4. The wrapper as defined in claim 1 wherein the magnesium hydroxide is present in a range between 5% and 25% of the total weight of the cellulosic sheet with 50% total filler by weight.

5. The wrapper as defined in claim 1 wherein the particle size of the magnesium hydroxide is not greater than 2 micrometers.

6. The wrapper as defined in claim 1 wherein the magnesium hydroxide is present in an amount only sufficient to coat the fibers of the cellulosic sheet.

7. The wrapper of claims 1, 2 or 4 in which the wrapper is cigarette paper.

8. The wrapper of claims 1, 2 or 4 in which the wrapper is cigar wrap.

9. A smoking article comprising a tobacco charge and a wrapper for the tobacco charge, said wrapper comprising a cellulosic sheet containing a filler of fine grain magnesium hydroxide having an average particle size less than 10 micrometers and unreactive magnesium oxide.

10. A smoking article as defined in claim 9 wherein the magnesium hydroxide is present in a range between 5% and 50% of the total weight of the cellulosic sheet.

11. A smoking article as defined in claims 9 or 10 wherein the particle size of the magnesium hydroxide is not greater than 10 micrometers.

12. A smoking article as defined in claim 9 wherein the magnesium hydroxide is present in a range between 2.5% and 25% of the total weight of the cellulosic sheet with 50% total filler by weight.

13. A smoking article as defined in claim 12 wherein the particle size of the magnesium hydroxide is not greater than 2 micrometers.

14. The invention defined in claim 9 wherein the smoking article is a cigarette.

15. The invention defined in claim 9 wherein the smoking article is a cigar.

16. A method for reducing the visible sidestream smoke emanating from a smoking article and solidifying the ash comprising wrapping the tobacco charge in the smoking article in a combustible cellulosic sheet containing a filler of fine grain magnesium hydroxide having an average particle size less than 10 micrometers and unreactive magnesium oxide.

17. The method defined in claim 16 wherein the magnesium hydroxide is present in a range between 5% and 50% of the total weight of the cellulosic sheet.

18. The method as defined in claims 16 or 17 wherein the particle size of the magnesium hydroxide is not greater than 10 micrometers.

19. The method defined in claim 16 wherein the magnesium hydroxide is present in a range between 2.5% and 25% of the total weight of the cellulosic sheet with up to 50% total filler by weight.

20. The wrapper as defined in claim 19 wherein the particle size of the magnesium hydroxide is not greater than 2 micrometers.

* * * * *